US005806835A

United States Patent [19]

Wood

[11] Patent Number: 5,806,835

[45] Date of Patent: Sep. 15, 1998

[54] LIFTING DEVICE FOR SNOWMOBILES AND OTHER LOADS

[76] Inventor: Leonard Brent Wood, 3628 Highway 11 N, Box 6703, North Bay, Ontario, Canada, P1B 8G3

[21] Appl. No.: 773,780

[22] Filed: Dec. 26, 1996

[51] Int. Cl.[6] ..... B66F 3/00

[52] U.S. Cl. ..... 254/116; 254/131

[58] Field of Search ..... 254/113–119, 131

[56] References Cited

U.S. PATENT DOCUMENTS

| | | | |
|---|---|---|---|
| 204,408 | 5/1878 | Woods | 254/117 |
| 209,211 | 10/1878 | Asire | 254/117 |
| 265,179 | 9/1882 | Swett | 254/119 |
| 1,293,026 | 2/1919 | Burgess | 254/131 |
| 1,334,482 | 3/1920 | Brittain | 254/113 |
| 1,458,324 | 6/1923 | Burns | 254/113 |

*Primary Examiner*—Robert C. Watson
*Attorney, Agent, or Firm*—Jones Tullar & Cooper, P.C.

[57] ABSTRACT

A lifting device particularly suitable for snowmobiles includes a frame with ground engaging feet, a lever pivotally mounted on the frame and connected to a load engaging post which is raised upon movement of the lever from an upper to a lower position, and a latch for holding the lever in its lower position to hold the post in its raised position. A safety catch is movably mounted on the lever for movement relative to the lever between an operative position, in which it prevents release of the lever from its latched position, and an inoperative position in which the lever can be moved from the lower to the upper position after release of the latch. The safety catch is movable relative to the lever under gravity and arranged so that it automatically moves to an operative position when the lever is moved to its lowered position and the load is lifted, and when the lever is in the lower position, if the catch is moved from the operative position to the inoperative position, the catch remains in the latter position while the latch continues to hold the lever in the lower position.

10 Claims, 4 Drawing Sheets

LIFTING DEVICE FOR SNOWMOBILES AND OTHER LOADS

BACKGROUND OF THE INVENTION

1. Field of the Invention

The present invention relates to a lifting device particularly suitable for lifting an end of a snowmobile, but also suitable for lifting other loads such as boats, boat trailers, etc.

2. Prior Art

For those working on snowmobiles there is a need to lift one end of the vehicle, usually the rear or tracked end, both in servicing the vehicle and to allow the snowmobile track to be run while raised off the ground, as in warming up the vehicle. Since the weight of a snowmobile is much smaller than that of a car, usually a fairly simple lever type device is used, the shorter end of the lever being connected to means for engaging the snowmobile, and the longer end being manually or foot operated. Devices of this general kind are shown for example in the following patents:

U.S. Pat. No. 3,667,728, issued Jun. 6, 1972, to Garelick,

U.S. Pat. No. 3,700,212, issued Oct. 24, 1972, to Morgenberger,

U.S. Pat. No. 3,907,254, issued Sep. 23, 1975, to Richards,

U.S. Pat. No. 3,964,729, issued Jun. 22, 1976, to Harlow,

U.S. Pat. No. 4,643,396, issued Feb. 17, 1987, to Beals,

U.S. Pat. No. 5,135,200, issued Aug. 4, 1992, to Neibrandt,

U.S. Pat. No. 5,143,352, issued Sep. 1, 1992 to Latimer,

U.S. Pat. No. 5,441,378, issued Aug. 15, 1995 to Puls,

Canadian Patent No. 1,277,654, issued Dec. 11, 1990 to Beaudet ; and

Canadian Patent Application No. 2,128,680, published Jan. 23, 1996.

These patents show various means for holding the load in the raised position, but some of these lack any positive securement so that the snowmobile could fall in the event that the lifting device or the vehicle itself is inadvertently jostled. For example, the Harlow and Neibrandt patents each depend on a lever staying in position, and if these levers were accidentally moved the snowmobile would fall. This is quite a possibility since snowmobiles are often worked on out-of-doors, where the operator may trip or slip on snow. This could be particularly hazardous if the track were to be running at the time.

Other patents show positive safety catches, but all have some drawbacks. Thus the patents of Garelick, Morgenberger, Richards, Beals, and the Canadian Patent Application No. 2,128,680, rely on catches which have to be manually applied, so might not be used by a careless worker.

Other designs, notably those of Puls and of Canadian Patent No. 1,277,654, show lever operated lifters which have safety devices which engage automatically when the load has been raised. However, these have the drawback that release of the safety catch is inconvenient. Since the safety catch is the only means holding the lever in the load lifted position, it can only be released when the user is holding the lever against movement by the load. This involves a crouching or stooping movement, which is sometimes awkward especially if it is desired to operate the lever by foot. In some prior designs, for example that of Niebrandt, foot operation is intended, and is a convenient way of operating a device of this kind.

SUMMARY OF THE INVENTION

The present invention provides a lifting device, suitable for snowmobiles and similar loads, having the following advantages over the prior art:

1. A positively engaging safety catch is provided which cannot be accidentally released;
2. The safety catch automatically moves into the operative position, in which it prevents movement of the lifting lever, once the lever has reached the proper operating position; and
3. When it is desired to lower the load, the safety catch can be released without immediately initiating lowering. This means that the operator can first release the latch, and then use his foot to lower the load; there is no need to simultaneously release the catch and control the lever.

In accordance with the present invention, a lifting device comprises:

a frame with ground engaging surfaces;

a lever pivotally mounted on the frame and connected to load engaging means which are raised upon movement of the lever from a first to a second position;

releasable means for holding the lever in the second position to hold the load engaging means raised; and a safety catch movably mounted on the lever for movement relative to the lever between an operative position, in which it prevents release of the lever from its second position, and an inoperative position in which the lever can be moved from the second to the first position after release of the releasable means.

The safety catch is movable relative to the lever under gravity and arranged so that:

a) with the lever in its second position, when the catch is moved from the operative position to the inoperative position, prior to lowering of the load, it remains in the latter position while the releasable means continues to hold the lever in the second position, b) when the lever is released from the second position and returned to the first position the pivoting of the lever causes the catch to move towards its operative position relative to the lever, and c) when the lever is moved from the first position into the second position the catch automatically assumes the operative position, and ensures that the lever remains in the second position.

The releasable means provides, in effect, a primary holding means for the lever, while the function of the safety catch is to prevent accidental release, such as could occur with the Harlow and Neibrandt designs. This allows the safety catch to be released without immediately causing the load to fall. The releasable holding means may include a latching surface engaged by the lever by sideways movement of the lever when it reaches the second position. The safety catch, when in the operative position, prevents sideways movement of the lever from the latching surface. Preferably, the safety catch is pivotally mounted on the lever.

Preferably also, the lever is moved downwards in going from the first position to the second position, and the lever is at a height suitable for foot operation. With the preferred design, foot operation can be used to engage and disengage the lever from the latching surface.

The lever may be confined in its movement between a member forming part of the frame and an elongated element extending parallel to the frame member, this frame member carrying the latching surface, and the elongated element forms part of the guide means limiting sideways movement of the lever by contact with the safety catch when it is in the operative position. The guide means has an end portion which deflects the lever sideways into engagement with the latching surface as it nears the second position, so that engagement with the latching surface is practically automatic. When the lever has engaged the latching surface, the safety catch also engages automatically. The latching surface and the lever have inclined surfaces which tend to hold the lever against release from the second position, even when the safety catch has been moved to the inoperative position.

The invention also provides advantages over the prior art in terms of the adjustability of height of the load engaging means; the manner in which these load engaging means accommodate misalignment caused by the lifting device and snowmobile being on uneven surfaces; in relation to the stability provided by the ground engaging means, particularly when used on sloping and slippery surfaces; and in relation to the ground clearance provided at the center of the device, allowing it to be operated in snow of fair depth.

BRIEF DESCRIPTION OF THE DRAWINGS

A preferred embodiment of the invention will now be described by way of example with reference to the accompanying drawings, in which.

DETAILED DESCRIPTION

Figure 1:
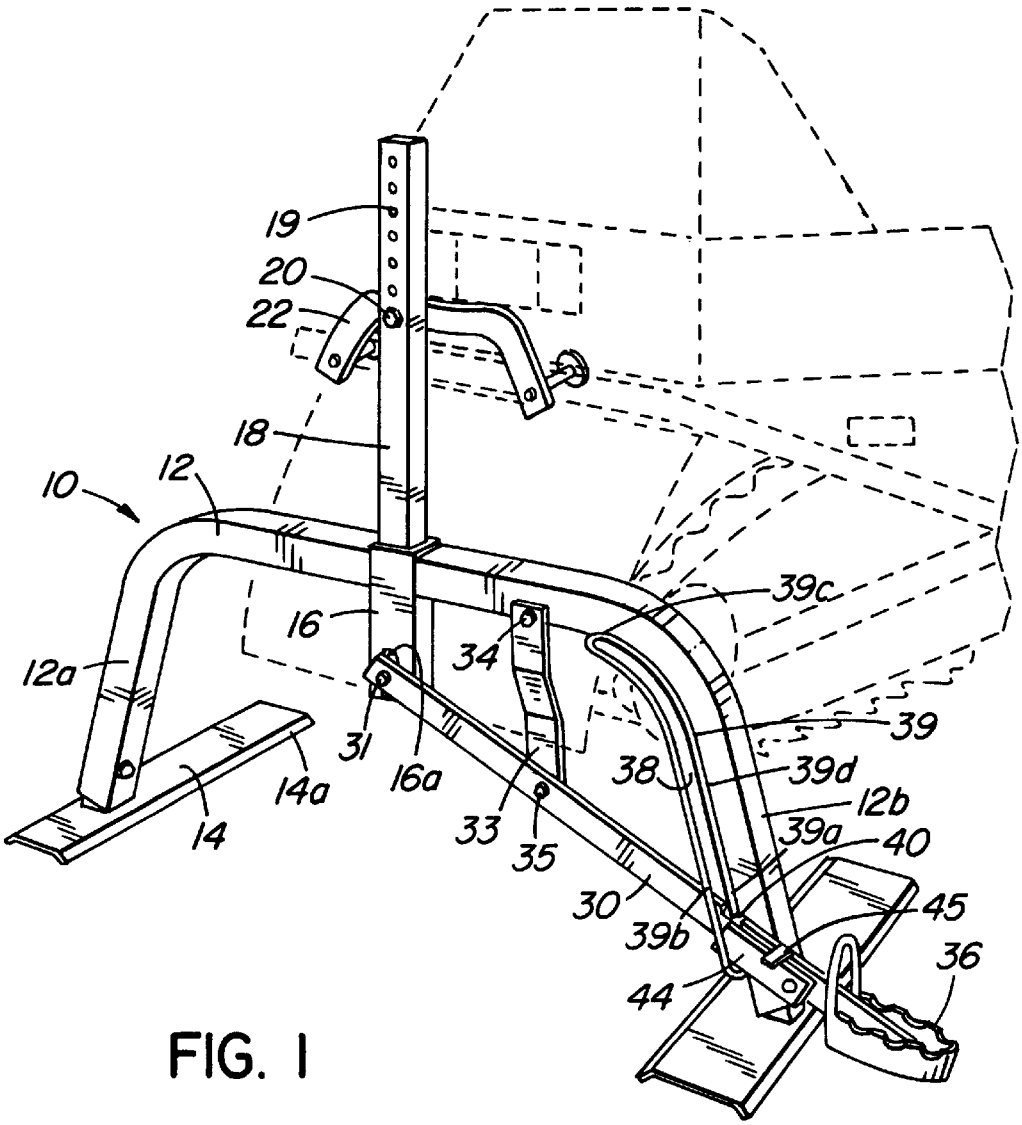
FIG. 1 is a perspective view of the lifting device (hereinafter termed the "lifter") in use holding up the rear end of a snowmobile which is shown in broken lines, the lever being in its second position and the safety catch being engaged.
Figure 2:
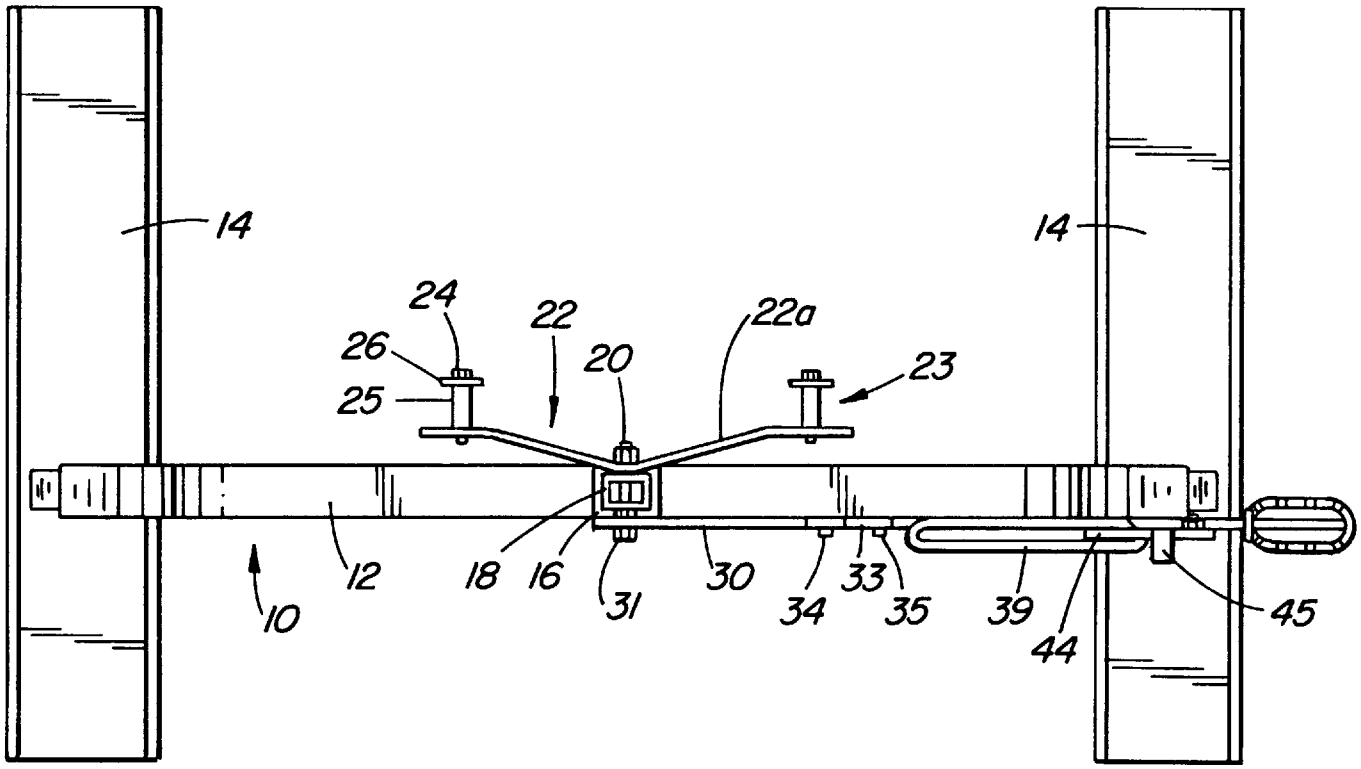
FIG. 2 shows a top view of the lifting device with the parts in the same position as in FIG. 1.

Referring to FIG. 1, the frame 10 of the lifter comprises a main member 12 of square tubing forming an inverted U shape, with outwardly splayed legs 12*a* and 12*b*. The bottom end of each leg is attached to a foot 14 which is a fore-and-aft ski type elongated plate with downturned outer edges 14*a*. The undersides of these feet have small flat bars (not shown) set on edge at the front and rear ends, and these bars and the edges 14*a* act as brakes and dig into snow to ensure that the feet do not slip, especially when a snowmobile is being warmed up. It will be seen from FIG. 2 that about one third of the feet are in front of the frame and about two-thirds are behind.

The center of the frame 12 carries a normally vertical, square section tubular socket 16 which slidably receives a square-sectioned load lifting post 18, the upper end of which is provided with a series of vertically spaced horizontal bores 19. One of these bores receives a bolt 20 which carries, at the rear of post 18, a load engaging yoke 22. This yoke has two side arms 22*a* bent away from the rear side of the frame and also sloping downwardly, and the ends of each arm has a lifting element 23 provided by a horizontal shoulder bolt 24 threaded into the arm, and carrying a sleeve 25 and a washer 26. These lifting elements are such that they can engage the usual bar which surrounds the rear end of a snowmobile, and the yoke can pivot on the bolt 20 to cope with unevenness of ground on which the snowmobile and lifter may be resting.

Figure 3A:
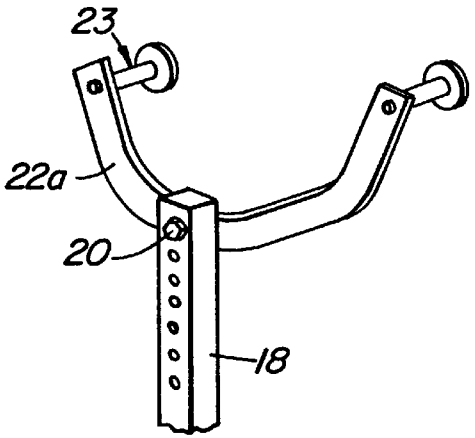
FIG. 3A shows an alternative arrangement of the load engaging means, as may be suited to a different snowmobile.

It will be apparent that the bores 19 in the lifting post provide a range of lifting heights. Additional range can be obtained by releasing the pivot 20 and replacing it after reversing the yoke so that its arms slope upwardly from the pivot, as shown in FIG. 3A.

The position of the lifting post 18 is controlled by lifting lever 30 connected to the post by a lower pivot 31, and which is also pivotally connected to the frame by a link 33 having an upper end pivoted to the frame at 34 and having its lower end providing a fulcrum for the lever at pivot 35. The link moves as necessary to allow straight line vertical sliding of the post 18 in the socket 16. The lower end of this socket is provided with a vertical slot 16*a* to allow the pivot 35 to move up higher than the bottom of the socket, giving extra range of movement for the lifting post. It may be noted that with this design the moving parts are raised well clear of the ground and are not unduly affected by the presence of snow, which could be the case with some previous designs such as that of Neibrandt.

Figure 1A:
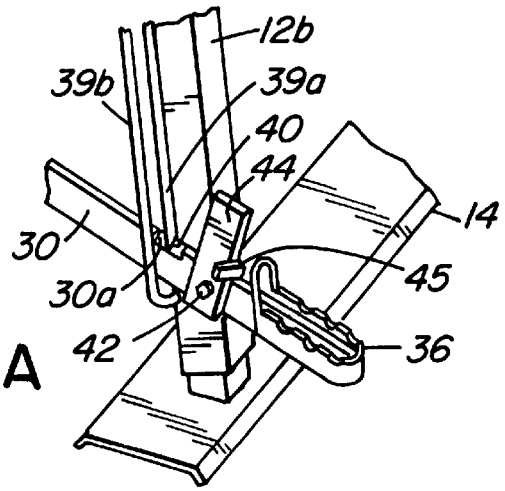
FIG. 1A shows a fragmentary view of the safety catch and associated parts, with the catch having been moved to its inoperative position prior to lowering of the snowmobile.

The outer end of lever 30 extends beyond the adjacent frame leg 12*b*, and is provided with a foot pedal 36 having a serrated, non-slip upper surface. Between the pedal and the fulcrum 35 the lever is laterally confined by a guideway indicated at 38 and formed of a rod 39, having a lower end 39*a* carried by and welded to the lower end of the frame leg 12*b*, an outer portion 39*b* providing an elongated element spaced from and parallel to the front of leg 12*b*, an upper end portion 39*c* formed as a loop which defines the upper end of travel or first position for the lever, and an inner portion 39*d* fixed to the front of the leg 12*b*. Rod 39 has a lower end 40 which is cut at an angle so as to slope inwards and upwards towards the leg 12*b*, and this lower end provides a sloping latch surface for the lever. The cooperating parts of the lever and latch surface are best shown in FIG. 1A, and it will be seen that the lever is provided with a ground away upper surface portion 30*a*, which has a slope corresponding to that of the latch surface 40. The arrangement is such that the guideway provided between the inner and outer portions of the rod 39*b* and 39*d* is just wide enough for the lever to slide, and such that the curved lower end of outer portion 39*b* of the rod deflects the lever into engagement with the latch surface 40 when it is pushed down to its second position, so that the latch provides holding means operable largely automatically when the pedal 36 is pushed down by a foot, the slope of the latch surface and of surface 30*a* tending to hold the lever in the latched, second position.

Between the pedal 36 and the guideway 38 the lever is provided with a pivot 42 for a safety catch 44. This is a straight strip of metal having a bar 45 welded across its top to limit its movement between an inoperative position shown in FIG. 1A and an operative position shown in FIG. 1. The catch is freely tiltable under gravity about pivot 42.

Operation will be described with reference to FIGS. 1, 1A, 3 and 4.

Figure 3:
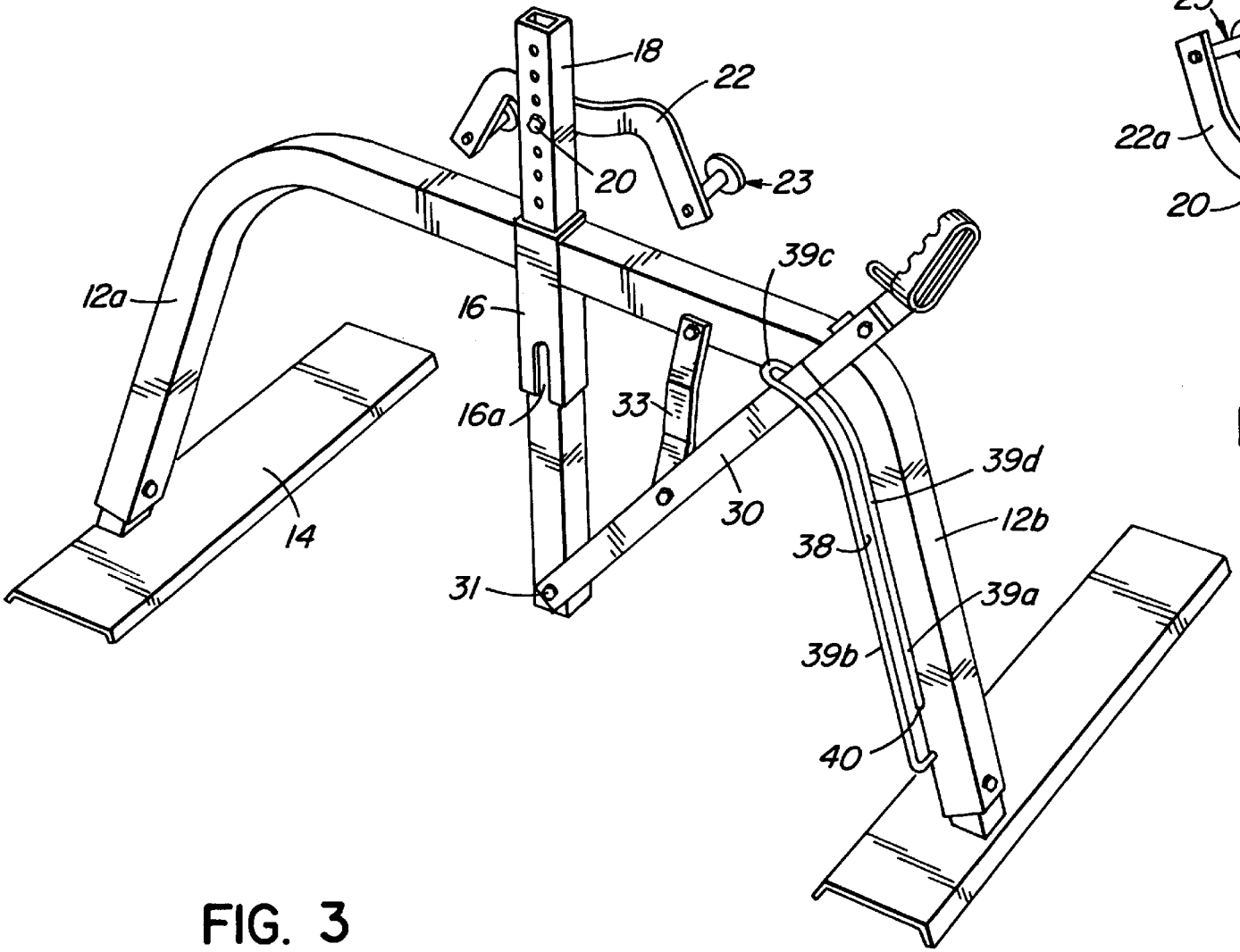
FIG. 3 is a perspective view of the lifting device with the load engaging means in the lowered position and the lever in its first position, prior to starting a lift.
Figure 4:
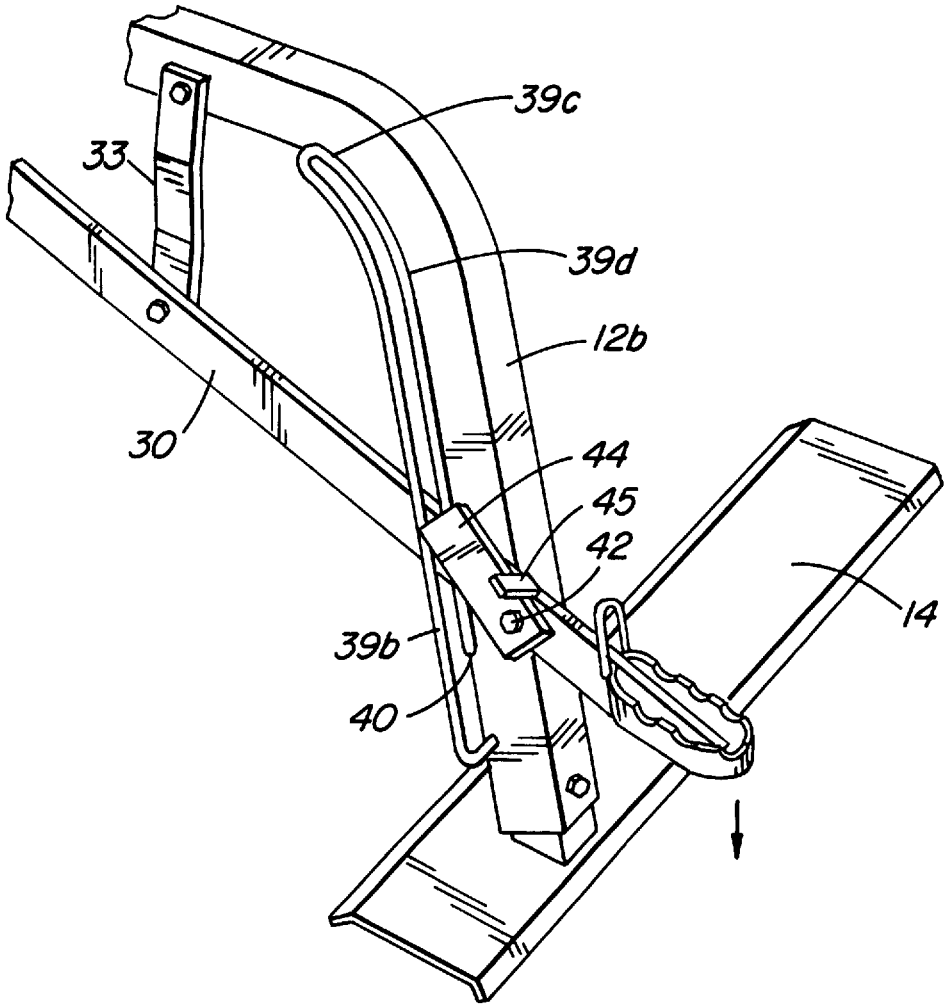
FIG. 4 shows a fragmentary view of the lever part of the lifting device while the lever is moving to its second position.

Starting with the lever in its first position as in FIG. 3, the lifter is placed, typically, behind a snowmobile, and the lever is pushed down by a foot until the yoke 22 engages and lifts the snowmobile. As the lever moves down, the safety catch 44 rides along the outer edge of the rod portion 39*b*, as shown in FIG. 4. Upon reaching the bottom of the guideway 38, the lever is deflected sideways by the lower end of the rod portion 39*b* into latching engagement with the latch surface 40, which engages sloping portion 30*a* of the lever. The sideways movement of the lever allows the catch 44 to fall beside rod portion 39*b* into the operative position, aligned with the lever, as shown in FIG. 1, where it contacts the inner side of rod portion 39*b* to positively prevent the lever from moving out of engagement with the latch surface 40. The lifter is then safe from any accidental jostling of the lever.

When the snowmobile is to be lowered, the catch 44 is moved manually to the inoperative position shown in FIG. 1A; with the lever in the downwardly sloping position the catch is "over center" relative to gravity so it remains in this position until the operator moves the lever, the lever still being held by latch surface 40. The lever again can be moved by foot, the operator firstly pushing the lever sideways out of engagement with the latch surface and then controlling movement of the lever as the load is lowered. In the final part of this movement, the upwards slope of the lever causes the catch 44 to return under gravity to the operative position shown in FIG. 3. The lifter is then ready for the next operation.

I claim:

1. A lifting device comprising:

a frame with ground engaging surfaces;

a lever pivotally mounted on the frame and connected to load engaging means which are raised upon movement of the lever from a first to a second position;

releasable means for holding the lever in said second position to hold the load engaging means in raised position;

a safety catch movably mounted on the lever for movement relative to the lever between an operative position, in which it prevents release of the lever from its second position, and an inoperative position in which the lever can be moved from the second to the first position after release of said releasable means, said safety catch being movable relative to the lever under gravity and arranged so that:

a) when the lever is in its second position, if the catch is moved from the operative position to the inoperative position the catch remains in the latter position while the releasable means continues to hold the lever in the second position, b) when the lever is returned from the second position to the first position the pivoting of the lever causes the catch to move towards its operative position relative to the lever, and c) when the lever is moved into the second position the catch automatically assumes the operative position and ensures that the lever remains in said second position.

2. A lifting device according to claim 1, wherein said releasable means includes a latching surface engaged by the lever by sideways movement of the lever when it reaches said second position, and said safety catch, when in the operative position, prevents sideways movement of the lever away from said latching surface.

3. A lifting device according to claim 1, wherein said safety catch is pivotally mounted on the lever.

4. A lifting device according to claim 1, wherein the lever moves downwardly in going from the first to the second position, and is suitable for foot operation, both for movement between the first and second positions and for release from said releasable means.

5. A lifting device comprising:

a frame with spaced apart ground engaging surfaces and a normally vertical tubular socket situated between said ground engaging surfaces;

a lever pivotally mounted on the frame and connected to load engaging means slidable in said socket and capable of lifting a load while the lever is moved from a first position to a second position;

a latch surface engageable by sideways movement of said lever when in said second position to hold the load lifted, guide means spaced from the latch surface so that the lever can normally move between the latch surface and the guide means, a safety catch pivotally mounted on said lever and movable from an inoperative position, in which it allows movement of the lever between the guide means and the latch surface, to an operative position in which it cooperates with the guide means to prevent sideways movement of the lever such as would release the lever from the latch surface, said safety catch being tiltable under gravity between said operative and inoperative positions so that:

a) when the lever is in its second position, if the catch is moved from the operative position to the inoperative position the catch remains in the latter position due to gravity, b) when the lever is returned from the second position to the first position the pivoting of the lever causes the catch to move towards its operative position relative to the lever, and c) when the lever has been moved into the second position and is engaged with the latching surface the catch automatically assumes the operative position and cooperates with said guide means to prevent release of the lever from the latching surface until the catch is moved.

6. A lifting device according to claim 5, wherein said lever is moved downwards in going from the first position to the second position, and wherein the lever is at a height suitable for foot operation.

7. A lifting device according to claim 5, wherein said lever is confined in its movement between a member forming part of the said frame and an elongated element extending parallel to said frame member, said frame member carrying said latching surface, said elongated element forming part of said guide means limiting sideways movement of the lever by contact with said safety catch when said catch is in the operative position, said guide means also serving to deflect the downwardly moving lever towards the latching surface.

8. A lifting device according to claim 5, wherein said load engaging means includes a post slidable in said socket and a yoke attached to said post by a horizontal pivot, said yoke having an arm on each side of said pivot with lifting elements projecting therefrom.

9. A lifting device according to claim 8, wherein said arms, in one position of the yoke, slope downwardly from said pivot, the pivot being releasable so that it can be reversed into another position with the arms sloping upwardly from the pivot.

10. A lifting device according to claim 5, wherein said load engaging means include a post attached by a lower pivot to the lever and slidable in said socket, the upper end of the post having a lifting yoke, and wherein the lower end of said socket has a slot for receiving said lower pivot.

* * * * *

UNITED STATES PATENT AND TRADEMARK OFFICE

CERTIFICATE OF CORRECTION

PATENT NO. : 5,806,835
DATED : September 15, 1998
INVENTOR(S) : Leonard Brent Wood It is certified that error appears in the above-identified patent and that said Letters Patent is hereby corrected as shown below:

Title page, item [73], Assignee should read as following:

-- Wood's Welding Limited
North Bay, Ontario P1B 8G3
Canada --

Signed and Sealed this

Twenty-fourth Day of August, 1999

*Attest:*

Q. TODD DICKINSON

*Attesting Officer*

*Acting Commissioner of Patents and Trademarks*